US012338028B2

(12) United States Patent
Reinhart

(10) Patent No.: US 12,338,028 B2
(45) Date of Patent: Jun. 24, 2025

(54) SHIPPING TRAY FOR BENCH SYSTEM AND METHOD

(71) Applicant: NICKOLAS BRANDS, LLC, Findlay, OH (US)

(72) Inventor: Nickolas Reinhart, Sarasota, FL (US)

(73) Assignee: Findlay Machine & Tool, LLC, Findlay, OH (US)

( * ) Notice: Subject to any disclaimer, the term of this patent is extended or adjusted under 35 U.S.C. 154(b) by 185 days.

(21) Appl. No.: 18/308,852

(22) Filed: Apr. 28, 2023

(65) Prior Publication Data

US 2023/0348135 A1 Nov. 2, 2023

Related U.S. Application Data

(60) Provisional application No. 63/335,924, filed on Apr. 28, 2022.

(51) Int. Cl.

| | |
|---|---|
| ***B65D 19/00*** | (2006.01) |
| ***B65D 19/38*** | (2006.01) |
| ***B65D 19/44*** | (2006.01) |
| ***B65D 71/70*** | (2006.01) |

(Continued)

(52) U.S. Cl.

CPC ..... *B65D 19/0018* (2013.01); *B65D 19/385* (2013.01); *B65D 19/44* (2013.01); *B65D 71/70* (2013.01); *B65D 85/62* (2013.01); *B65D 85/64* (2013.01); *B65D 2519/00308* (2013.01); *B65D 2519/00407* (2013.01); *B65D 2519/0096* (2013.01)

(58) Field of Classification Search

CPC ..... B65D 19/0018; B65D 21/02; B65D 21/0201; B65D 21/2102; B65D 71/70; B65D 85/62; B65D 85/64

See application file for complete search history.

(56) References Cited

U.S. PATENT DOCUMENTS 4,183,491 A * 1/1980 Sanders ..... B65D 19/0024 248/346.02
5,101,964 A * 4/1992 Westphal ..... B62D 65/18 206/386

(Continued)

FOREIGN PATENT DOCUMENTS

DE 102008022366 A1 11/2009
DE 102009041436 A1 3/2011

(Continued)

*Primary Examiner* — Daniel J Rohrhoff
(74) *Attorney, Agent, or Firm* — Jacob M. Ward; Ward Law Office LLC

(57) ABSTRACT

A shipping tray for a bench system and method of use are provided. The shipping tray may include a front support, rear support, first side support, and second side support. The shipping tray may further include a first front holder, a second front holder, a third front holder, a first rear holder, a second rear holder, and a third rear holder, all configured to receive one of a plurality of legs of a bench. The shipping tray may further include a central brace, a first X-brace, and a second X-brace. There may be a network of ribbing on the underside of the shipping tray. The shipping tray may be used for stacking a bench, or multiple benches, onto the shipping tray. The shipping tray may also be stacked on top of another shipping tray.

15 Claims, 8 Drawing Sheets

(51) Int. Cl.
*B65D 85/62* (2006.01)
*B65D 85/64* (2006.01)

(56) References Cited

U.S. PATENT DOCUMENTS

| | | | | |
|---|---|---|---|---|
| 6,474,245 | B2 * | 11/2002 | Richard | B62B 5/0083 108/54.1 |
| 7,503,571 | B2 * | 3/2009 | Cromie | B62B 3/16 280/47.11 |
| 8,438,981 | B2 * | 5/2013 | Linares | B65D 19/0095 108/57.25 |
| 8,555,787 | B2 | 10/2013 | Haaf | |
| 8,701,569 | B2 * | 4/2014 | Linares | B65D 19/0028 108/51.3 |
| 9,162,797 | B1 * | 10/2015 | Suiter | B65D 19/0018 |
| 9,440,770 | B2 | 9/2016 | Mueller | |
| D776,932 | S * | 1/2017 | Reinhart | D3/318 |
| 10,399,739 | B2 | 9/2019 | Lenz et al. | |
| 10,604,298 | B2 | 3/2020 | Ramon et al. | |
| 10,661,944 | B2 * | 5/2020 | Apps | B65D 19/385 |
| 10,737,834 | B2 | 8/2020 | Veldhuis et al. | |
| 10,850,889 | B2 | 12/2020 | Ramon et al. | |
| 11,014,708 | B1 * | 5/2021 | Cohen | B65D 71/0096 |
| D925,158 | S | 7/2021 | Ramon et al. | |
| D925,859 | S | 7/2021 | Ramon et al. | |
| 11,174,070 | B2 * | 11/2021 | Kalinowski | B65D 19/0018 |
| D1,010,447 | S * | 1/2024 | Reinhart | D9/456 |
| D1,033,227 | S * | 7/2024 | Reinhart | D9/456 |
| 2009/0050030 | A1 * | 2/2009 | Apps | B65D 19/0018 206/518 |
| 2012/0037050 | A1 * | 2/2012 | Nevo | B65D 19/0038 108/51.11 |
| 2013/0032507 | A1 * | 2/2013 | Du Toit | B65D 19/0018 206/599 |
| 2015/0040803 | A1 * | 2/2015 | Burk | B65D 19/0038 108/57.29 |
| 2015/0274359 | A1 * | 10/2015 | Linares | B65D 19/0004 108/53.1 |
| 2023/0264857 | A1 * | 8/2023 | Reinhart | B65D 19/0002 206/326 |
| 2024/0351742 | A1 * | 10/2024 | Caldwell | B65D 85/62 |

FOREIGN PATENT DOCUMENTS

| | | | |
|---|---|---|---|
| DE | 102012221279 | A1 | 5/2014 |
| EP | 3135596 | A1 | 3/2017 |
| WO | 2011107429 | A1 | 9/2011 |

* cited by examiner

SHIPPING TRAY FOR BENCH SYSTEM AND METHOD

CROSS-REFERENCE TO RELATED APPLICATIONS

This application claims the benefit of U.S. Provisional Application No. 63/335,924, filed on Apr. 28, 2022. The entire disclosure of the above application is incorporated by reference.

FIELD

The present technology includes processes and articles of manufacture that relate to shipping trays, including a shipping tray for a bench system and method.

INTRODUCTION

Storing and transporting goods as they move through the supply chain can be costly, especially when there is a large quantity goods, conditions for storage or transport are not ideal, or the goods are fragile. Shipping trays may reduce costs of storage and transport by providing a structure and pattern of reinforcement specific to the goods being handled. Traditionally, shipping trays employ a more general structure capable of accommodating a variety of different goods, and may or may not include a pattern of reinforcement. While these shipping trays may be versatile, they lack the structure and pattern of reinforcement suited for some goods, and thus may not adequately support or protect goods, or facilitate ease of storage and transport.

Alternatively, specialized shipping trays consider and conform to the specific nature of the goods being handled, and can combat the lack of ideal storage and transport conditions. With a specialized structure and pattern of reinforcement, the goods are adequately supported and protected. These specialized shipping trays can reduce transport time because they may be strong enough to accommodate movement by industrial vehicles like forklifts or pallet jacks. Specialized shipping trays may further allow for support and transport of larger quantities of goods at once, depending on structure and pattern of reinforcement, by allowing goods or shipping trays to stack, for example. Specialized shipping trays may reduce costs and the risk that goods will be damaged in storage or transport.

Accordingly, there is a need for a shipping tray for a bench system having a structure and pattern of reinforcements that adequately supports the bench system, combating the lack of ideal storage and transport conditions, by increasing storage and transport efficiency, and reducing the risk of damage.

SUMMARY

In concordance with the instant disclosure, a shipping tray for a bench system having a structure and pattern of reinforcements that adequately supports the bench system, that combats the lack of ideal storage and transport conditions, by increasing storage and transport efficiency, and reducing the risk of damage, has surprisingly been discovered.

In one embodiment, a shipping tray for receiving a bench that has a plurality of legs, may include a front support, a rear support, a first side support, and a second side support forming a perimeter of the shipping tray. Positioned along the front support, there may be a first front holder, a second front holder, and a third front holder, each having a recess configured to receive a leg of the plurality of legs of the bench. The third front holder may be positioned between the first front holder and the second front holder. The shipping tray may also include, positioned along the rear support, a first rear holder, a second rear holder, and a third rear holder, each having a recess configured to receive a leg of the plurality of legs of the bench. The third rear holder may be positioned between the first rear holder and the second rear holder. The shipping tray may include a central support connecting the third front holder to the third rear holder. There may also be a central support connected to the third front holder and the third rear holder, a first X-support and a second X-support. The first X-support may be connected to the first front holder, the first rear holder, the third front holder, and the third rear holder. The second X-support may be connected to the second front holder, the second rear holder, the third front holder, and the third rear holder. The shipping tray may also include a network of ribbing on the underside of the shipping tray.

In another embodiment, a method of stacking a bench having a plurality of legs on a shipping tray. The method including the steps of, providing a shipping tray for receiving a bench that has a plurality of legs. The shipping tray may include a front support, a rear support, a first side support, and a second side support forming a perimeter of the shipping tray. Positioned along the front support, there may be a first front holder, a second front holder, and a third front holder, each having a recess configured to receive a leg of the plurality of legs of the bench. The third front holder may be positioned between the first front holder and the second front holder. The shipping tray may also include, positioned along the rear support, a first rear holder, a second rear holder, and a third rear holder, each having a recess configured to receive a leg of the plurality of legs of the bench. The third rear holder may be positioned between the first rear holder and the second rear holder. The shipping tray may include a central support connecting the third front holder to the third rear holder. There may also be a central support connected to the third front holder and the third rear holder, a first X-support and a second X-support. The first X-support may be connected to the first front holder, the first rear holder, the third front holder, and the third rear holder. The second X-support may be connected to the second front holder, the second rear holder, the third front holder, and the third rear holder. The shipping tray may also include a network of ribbing on the underside of the shipping tray. The method may then include the step of, disposing the bench on the shipping tray, by disposing a leg of the plurality of legs into each recess of the first front holder, the second front holder, the third front holder, the first rear holder, the second rear holder, and the third rear holder of the shipping tray.

In another embodiment, a method of stacking a second shipping tray on a first shipping tray. The method including the steps of, providing a first shipping tray and a second shipping tray. The first shipping tray and the second shipping tray may each include a front support, a rear support, a first side support, and a second side support forming a perimeter of the shipping tray. Positioned along the front support, there may be a first front holder, a second front holder, and a third front holder, each having a recess configured to receive a leg of the plurality of legs of the bench. The third front holder may be positioned between the first front holder and the second front holder. The shipping tray may also include, positioned along the rear support, a first rear holder, a second rear holder, and a third rear holder, each having a recess configured to receive a leg of the plurality of legs of the bench. The third rear holder may be positioned between the first rear holder and the second rear holder. The shipping tray may include a central support connecting the third front holder to the third rear holder. There may also be a central support connected to the third front holder and the third rear holder, a first X-support and a second X-support. The first X-support may be connected to the first front holder, the first rear holder, the third front holder, and the third rear holder. The second X-support may be connected to the second front holder, the second rear holder, the third front holder, and the third rear holder. The shipping tray may also include a network of ribbing on the underside of the shipping tray. The method may then include the step of, disposing the underside of the second shipping tray on a top of the first shipping tray.

Further areas of applicability will become apparent from the description provided herein. The description and specific examples in this summary are intended for purposes of illustration only and are not intended to limit the scope of the present disclosure.

DRAWINGS

DETAILED DESCRIPTION

Figure 1:
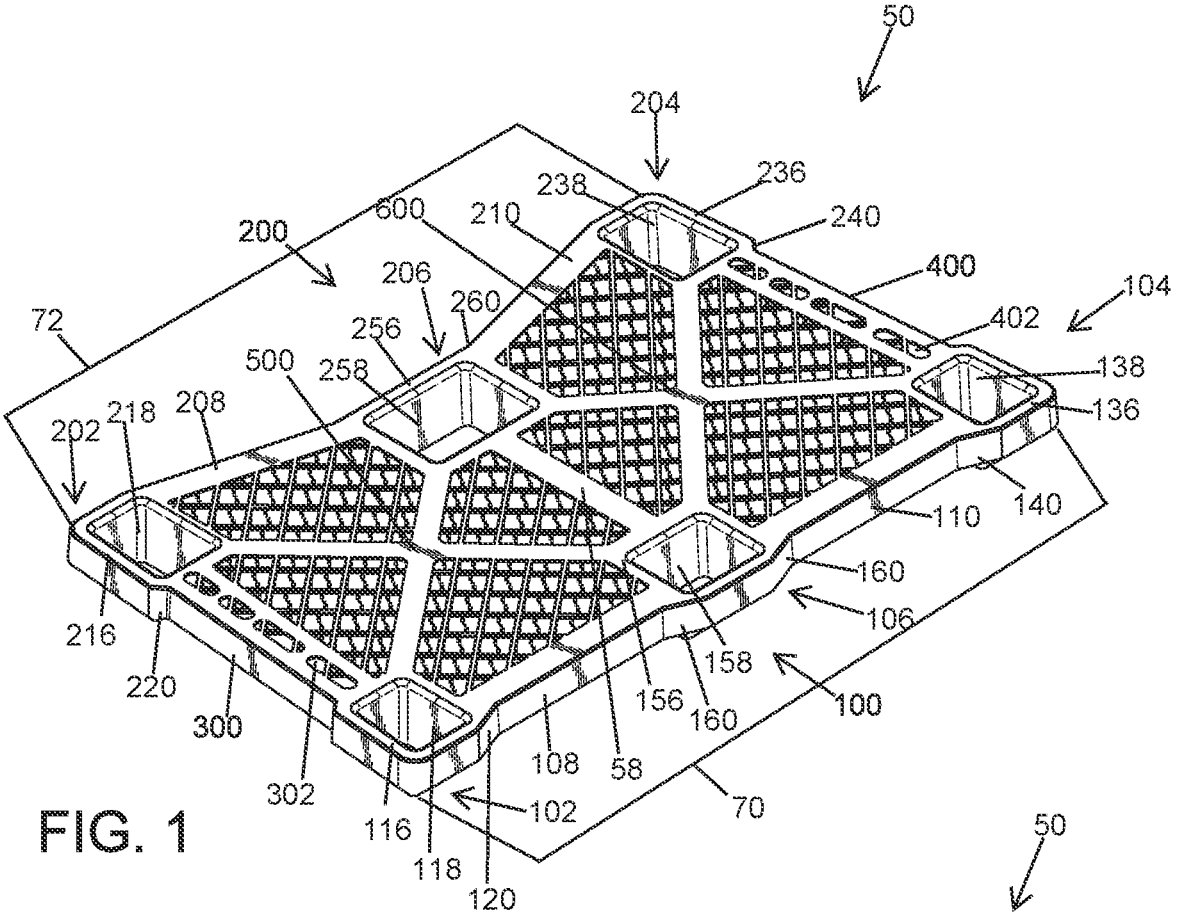
FIG. 1 is a top perspective view of the shipping tray in the present disclosure.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed, unless expressly stated otherwise. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of" Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3,3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
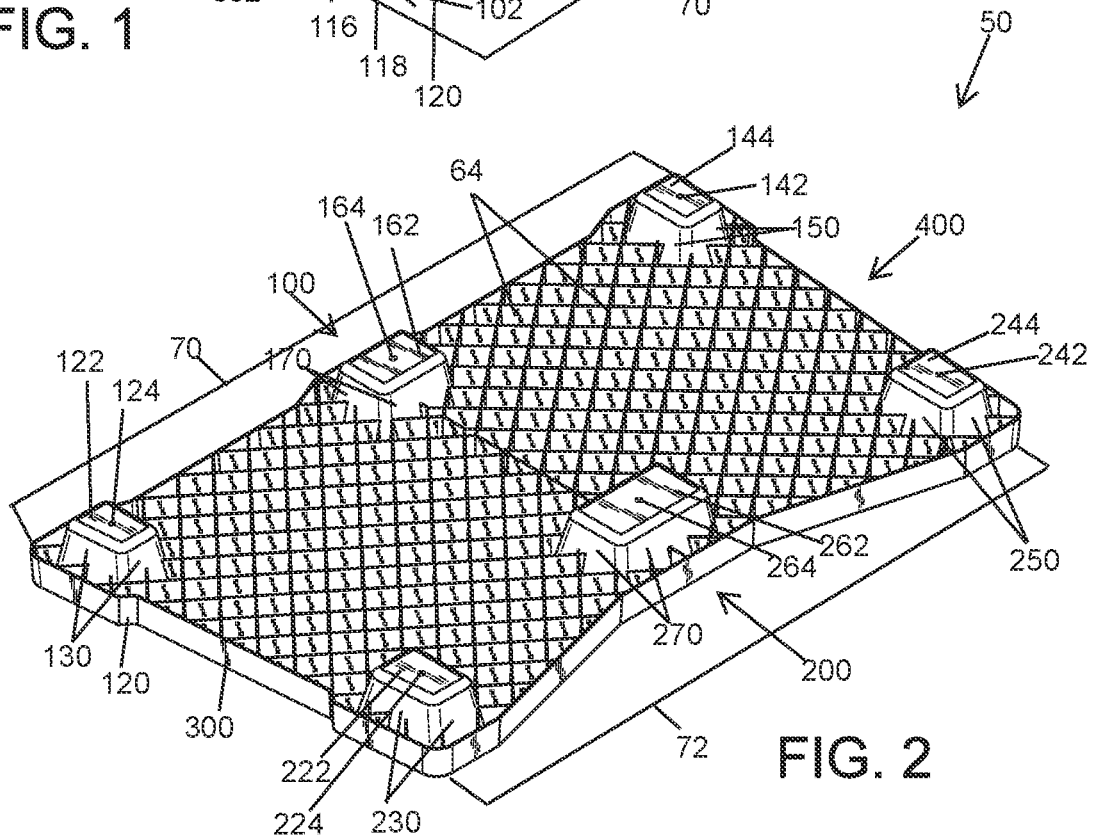
FIG. 2 is a bottom perspective view of the shipping tray.
Figure 4:
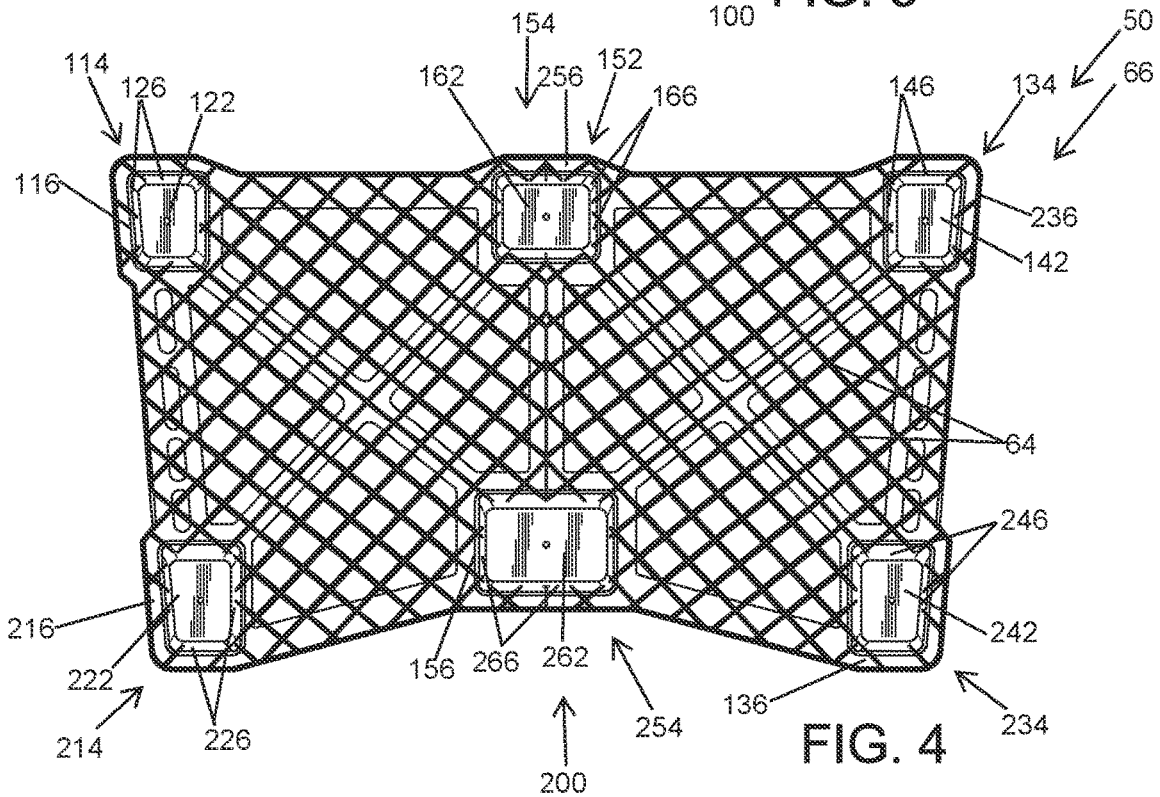
FIG. 4 is a bottom plan view of the shipping tray.
Figure 5:
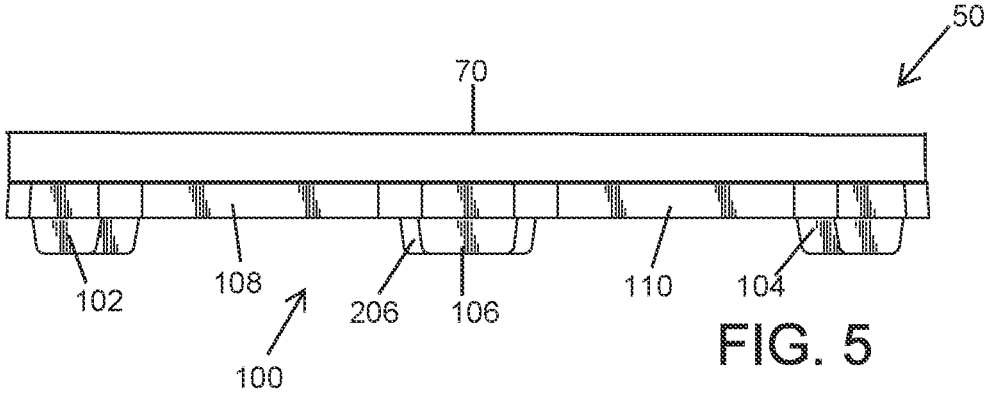
FIG. 5 is a front elevational view of the shipping tray.
Figure 6:
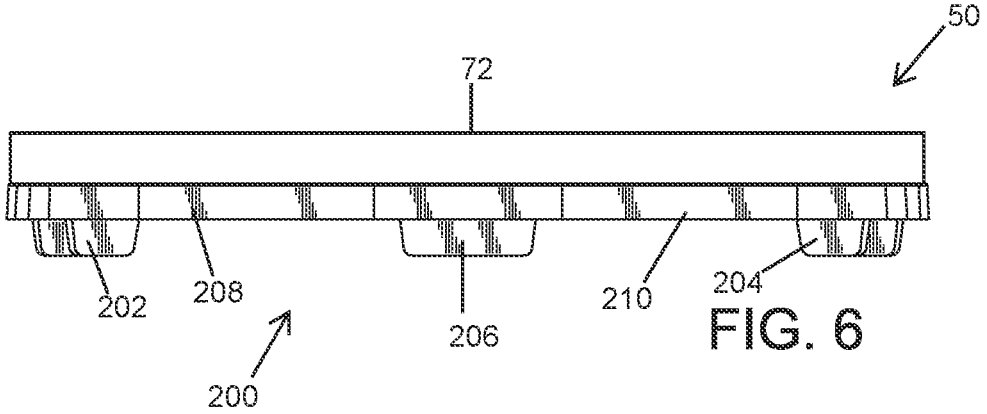
FIG. 6 is a rear elevational view of the shipping tray.
Figure 7:
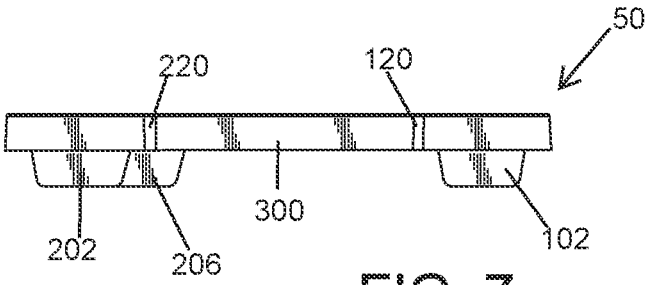
FIG. 7 is a side elevational view of the first side support of the shipping tray.
Figure 8:
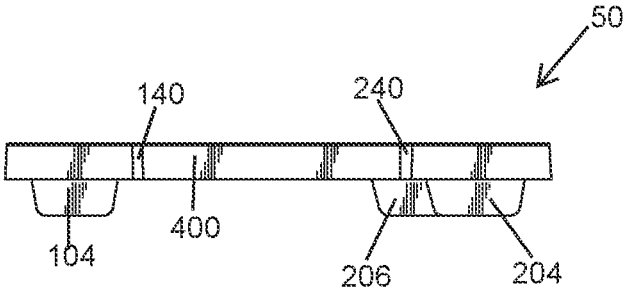
FIG. 8 is a side elevational view of second side support of the shipping tray.

The present technology improves on shipping trays for benches. The present disclosure includes a shipping tray 50 for a bench 54 having a plurality of legs 56. As shown in FIGS. 1-2, the shipping tray 50 may include, a front support 100, a rear support 200, a first side support 300, and a second side support 400. There may be a first front holder 102, a second front holder 104, and a third front holder 106. Additionally, there may be a first rear holder 202, a second rear holder 204, and a third rear holder 206. There may be a central support 58, a first X-support 500, and a second X-support 600, as well as a network of ribbing 64 located on an underside 66 of the shipping tray 50, as shown in FIG. 4.

Figure 9:
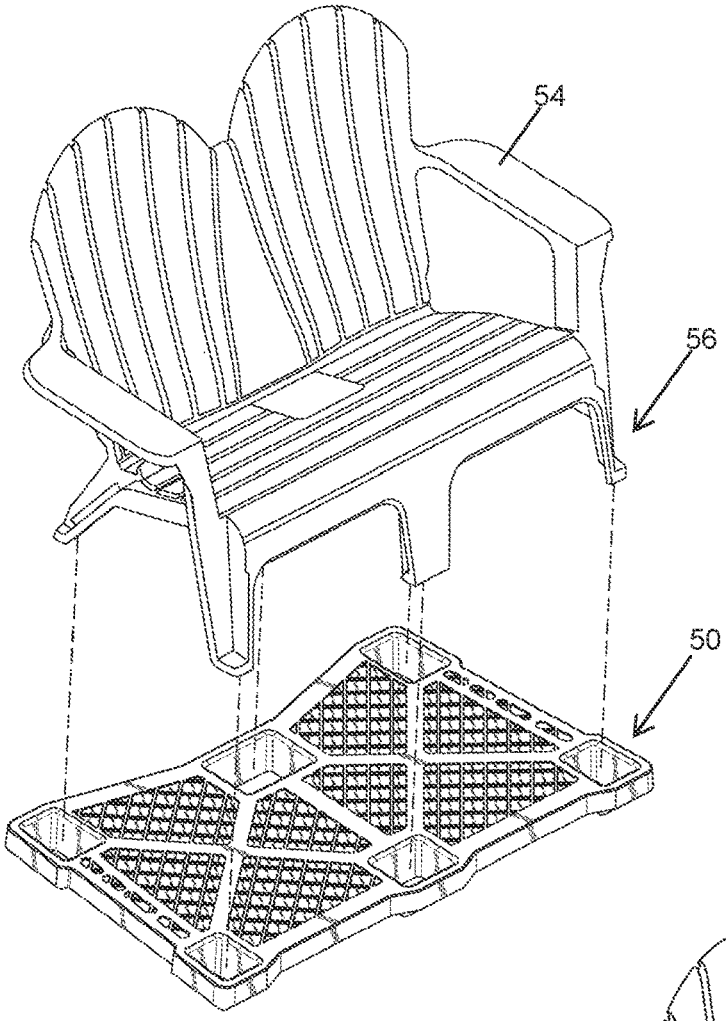
FIG. 9 is a top perspective view depicting the stacking of a bench on the shipping tray, where broken lines indicate alignment of the bench relative to being placed in the shipping tray.
Figure 10:
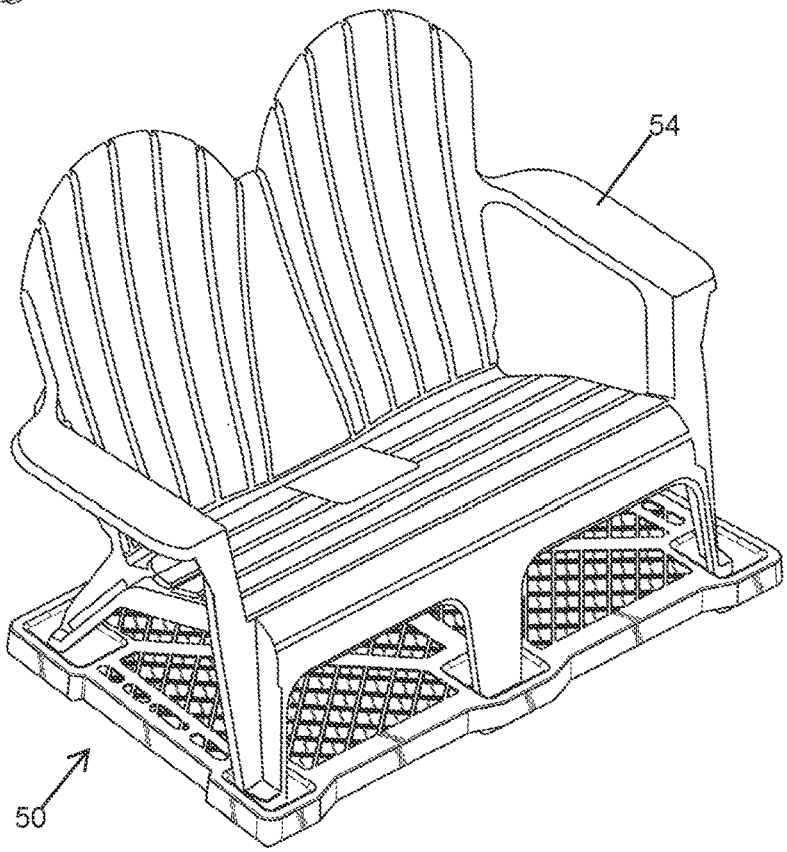
FIG. 10 is a top perspective view of the bench disposed on the shipping tray.
Figure 11:
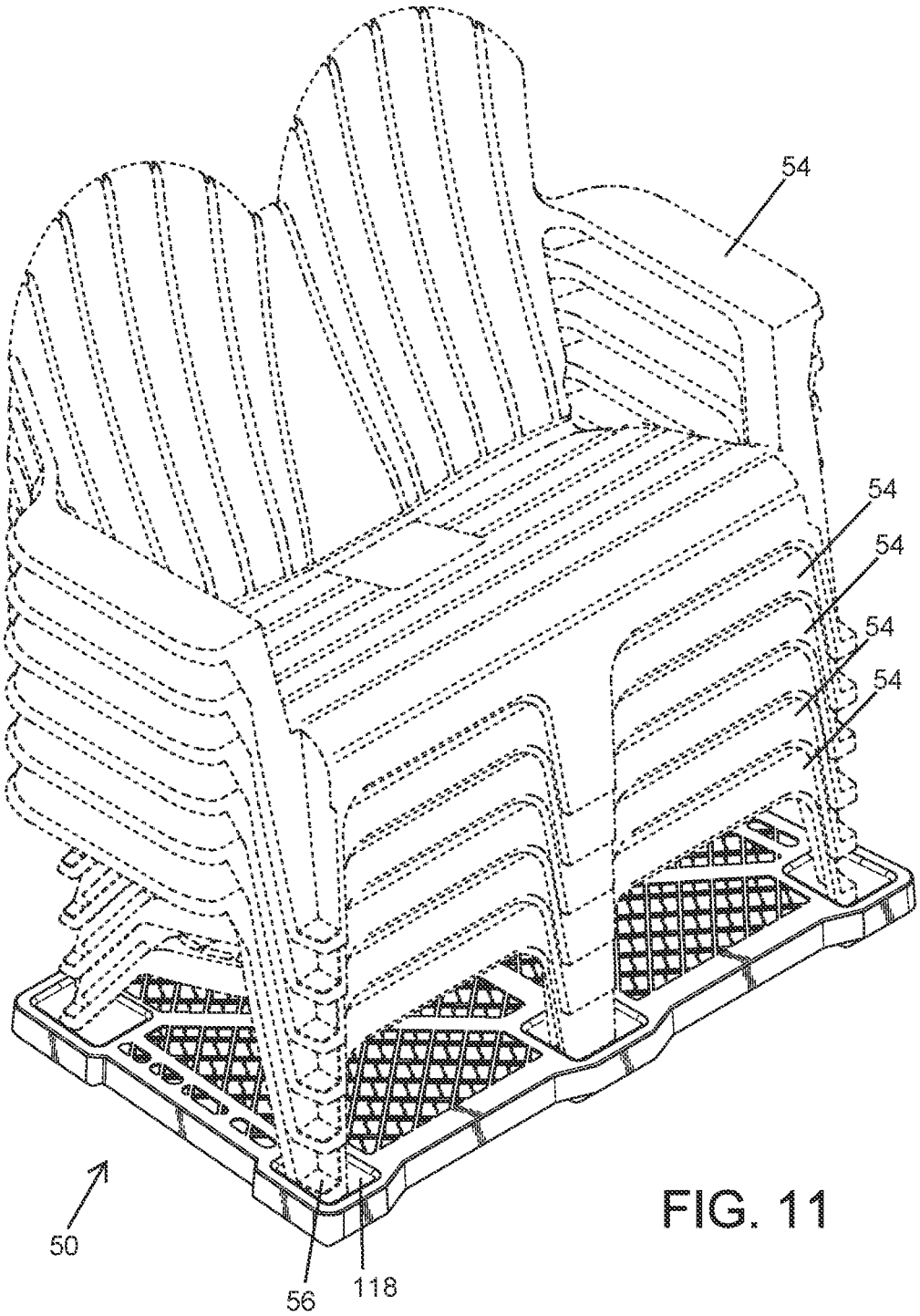
FIG. 11 is a top perspective view of the shipping tray showing multiple nested benches stacked thereon.

As shown in FIG. 1, the front support 100, the rear support 200, the first side support 300, and the second side support 400 may form a perimeter of the shipping tray 50. The front support 100 may have a first length 70, and the rear support 200 may have a second length 72. As shown in FIGS. 1-2 and 5-6, the first length 70 of the front support 100 may be longer than the second length 72 of the rear support 200, to accommodate the shape of the bench 54. However, any lengths or configurations of the front support 100, the rear support 200, the first side support 300, and the second side support 400, relative to each other, may be used as deemed appropriate by one skilled in the art. Different relative lengths and configurations may correspond to a variety of types of benches 54, including, but not limited to Adirondack-style benches 54 with six legs, as shown in FIGS. 9-11.

Figure 3:
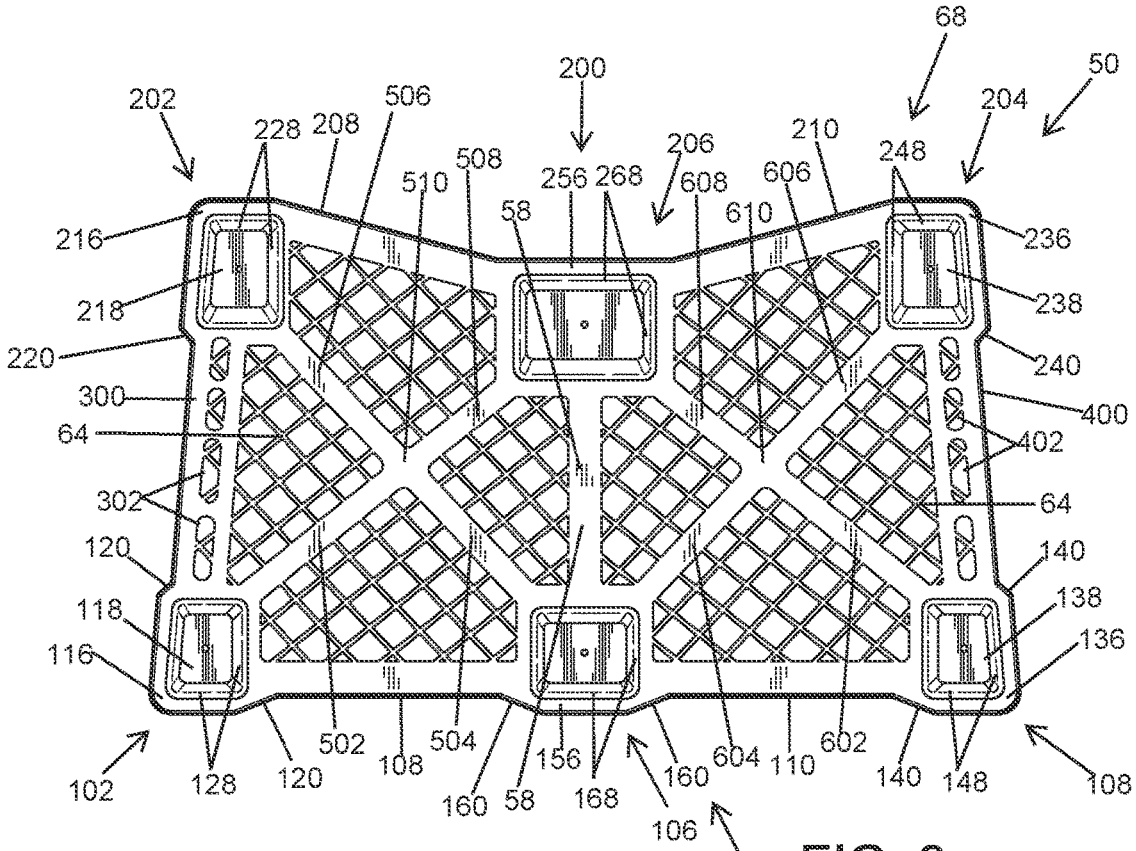
FIG. 3 is a top plan view of the shipping tray.

As shown in FIGS. 1 and 3, the front support 100 may include a first arm 108 and a second arm 110. The first arm 108 may extend between the first front holder 102 and the third front holder 106. The second arm 110 may extend between the second front holder 104 and the third front holder 106.

As shown in FIGS. 1 and 3, the rear support 200 may include a first arm 208 and a second arm 210. The first arm 208 may extend between the first rear holder 202 and the third rear holder 206. The second arm 210 may extend between the second rear holder 204 and the third rear holder 206. As shown in FIG. 3, the first arm 208 of the rear support 200 may angle inward toward the front support 100, from the first rear holder 202 to the third rear holder 206. Likewise, the second arm 210 of the rear support 200 may angle inward toward the front support 100, from the second rear holder 204 to the third rear holder 206. The precise angling of the first arm 208 and the second arm 210 of the rear support 200 may vary and is not limited to what is shown in FIG. 3. Depending on the bench 54 being accommodated, different angling, or no angling of the rear support 200 may be deemed necessary by one skilled in the art.

As shown in FIG. 1, the first side support 300 may extend between the first front holder 102 and the first rear holder 202. The second side support 400 may extend between the second front holder 104 and the second rear holder 204. The first side support 300 may have a plurality of openings 302 formed within. Similarly, the second side support 400 may also have a plurality of openings 402 formed within. As shown in FIGS. 1 and 3, the plurality of openings 302, 402 may be serially arranged, where each opening may be elongated and may be stadium-shaped. However, the plurality of openings 302, 402 may be in any number, arrangement, shape, and size as deemed necessary by one skilled in the art, including but not limited to the plurality of openings 302, 402 shown in FIGS. 1 and 3. The number, arrangement, shape, and size of the plurality of openings 302, 402 may differ. Depending on the type of bench 54 being accommodated, the plurality of openings 302, 402 that most effectively reduces manufacturing materials without compromising structural integrity, may be implemented.

As shown in FIGS. 1 and 3, the first front holder 102, the second front holder 104, and the third front holder 106 may each be positioned along the front support 100. As shown in FIGS. 1, 3 and 4, the first front holder 102 may include a foot 114 and a holder border 116. The foot 114 extends down from the underside 66 of the shipping tray 50. The foot 114 may further include a recess 118 configured to receive one of a leg 56 of the plurality of legs 56 of the bench 54, the recess 118 receiving the leg 56 into it from a top 68 of the shipping tray 50. The holder border 116 may surround the recess 118, and may further include an angled side 120 connecting the holder border 116 to the front support 100 and the first side support 300.

Figure 12:
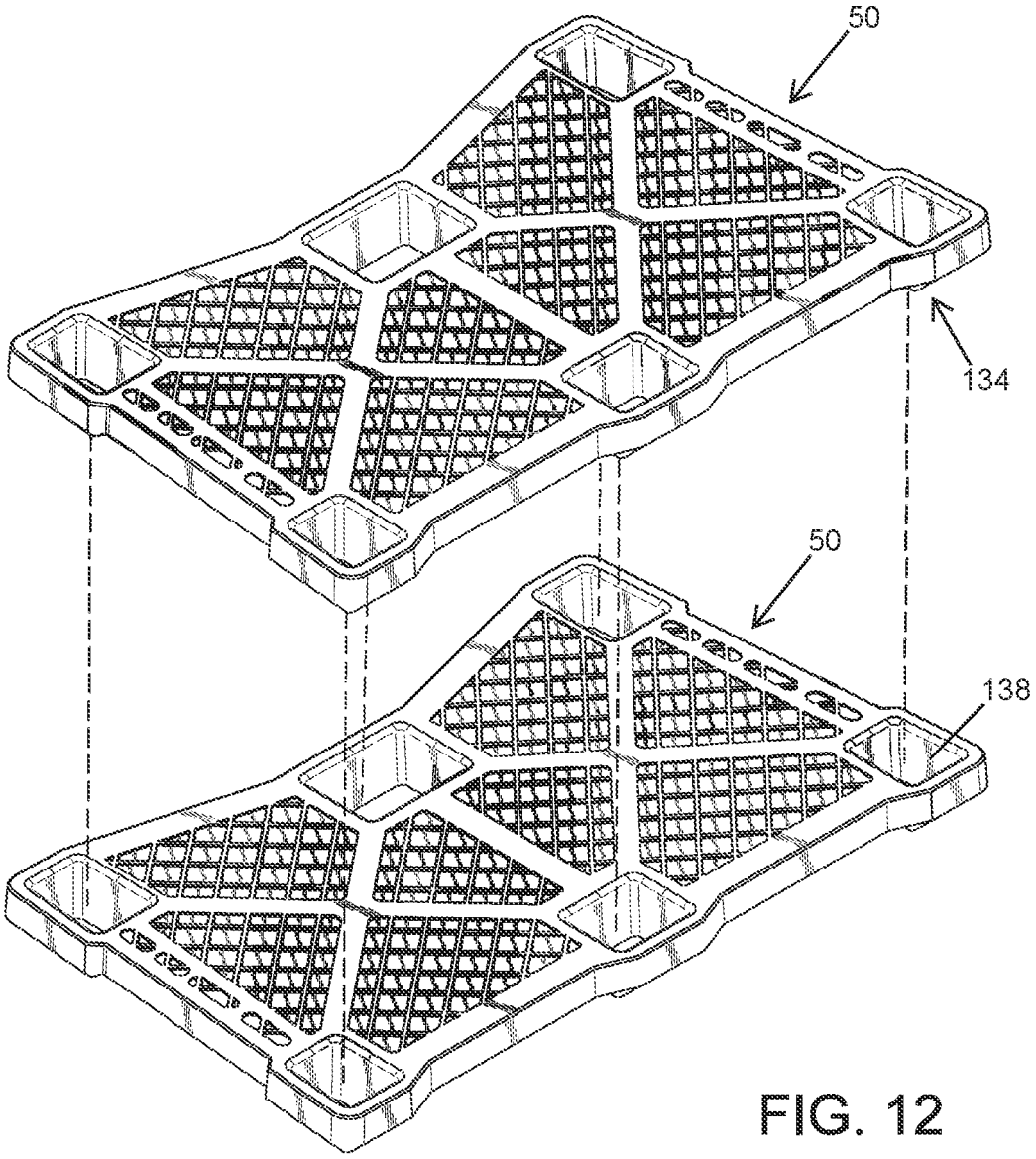
FIG. 12 is a top perspective view depicting the nesting of the shipping tray in another shipping tray, where broken lines indicate alignment therebetween.
Figure 13:
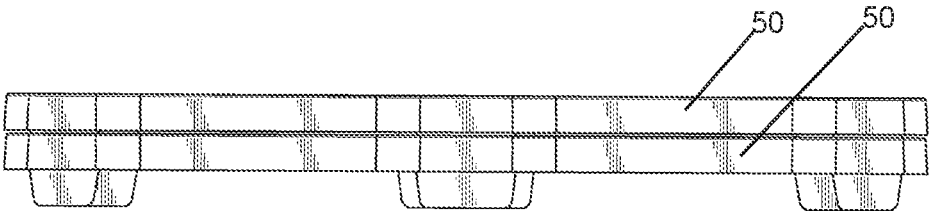
FIG. 13 is a front perspective view the shipping tray nested in another shipping tray resting in the shipping tray.

As shown in FIGS. 1 and 4, the recess 118 of the first front holder 102 may have a base 122 with a drainage hole 124, and a plurality of walls 126. The plurality of walls 126 may angle inward relative to each other and extend downward from the holder border 116 to the base 122. The plurality of walls 126 may have an inner surface 128 and an outer surface 130. In some embodiments, the recess 118 of the first front holder 102 may be configured to receive the foot 114 of another shipping tray 50, as shown in FIGS. 12-13. When stacked and nested together, the inner surface 128 of the recess 118 of the shipping tray 50 may abut with the outer surface 130 of the recess 118 of the foot of the another shipping tray 50. The first front holder 102 may be rectangular, as shown in FIG. 3. However, size, shape, and depth may vary depending on the bench 54 being accommodated. The first front holder 102 may be of any size, shape, and depth as deemed appropriate by one skilled in the art.

As shown in FIGS. 1, 3, and 4, the second front holder 104 may include a foot 134 and a holder border 136. The foot 134 extends down from the underside 66 of the shipping tray 50. The foot 134 may further include a recess 138 configured to receive one of a leg 56 of the plurality of legs 56 of the bench 54, the recess 138 receiving the leg 56 into it from the top 68 of the shipping tray 50. The holder border 136 may surround the recess 138, and may further include an angled side 140 connecting the holder border 136 to the front support 100, and the second side support 400.

As shown in FIGS. 1-4, the recess 138 of the second front holder 104 may have a base 142 with a drainage hole 144, and a plurality of walls 146. The plurality of walls 146 may angle inward relative to each other, and extend downward from the holder border 136 to the base 142. The plurality of walls 146 may have an inner surface 148 and an outer surface 150. In some embodiments, the recess 138 of the second front holder 104 may be configured to receive the foot 134 of another shipping tray 50, as shown in FIGS. 12-13. When stacked and nested together, the inner surface 148 of the recess 138 of the shipping tray 50 may abut with the outer surface 150 of the recess 138 of the foot 134 of another shipping tray 50.

The second front holder 104 may be rectangular, as shown in FIG. 3. However, size, shape, and depth may vary depending on the bench 54 being accommodated. The second front holder 104 may be of any size, shape, and depth as deemed appropriate by one skilled in the art.

As shown in FIGS. 1, 3, and 4, the third front holder 106 may be positioned between the first front holder 102 and the second front holder 104. The third front holder 106 may include a foot 154 and a holder border 156. The foot 154 extends down from the underside 66 of the shipping tray 50. The foot 154 may further include a recess 158 configured to receive one of a leg 56 of the plurality of legs 56 of the bench 54, the recess 158 receiving the leg 56 into it from the top 68 of the shipping tray 50. The holder border 156 may surround the recess 158, and may further include an angled side 160 connecting the holder border 156 to the first arm 108 and the second arm 110 of the front support 100.

As shown in FIGS. 1 and 3, the recess 158 of the third front holder 106 may have a base 162 with a drainage hole 164, and a plurality of walls 166. The plurality of walls 166 may angle inward relative to each other, and extend downward from the holder border 156 to the base 162. The plurality of walls 166 may have an inner surface 168, and an outer surface 170. In some embodiments, the recess 158 of the first font holder may be configured to receive the foot 154 of another shipping tray 50, as shown in FIGS. 12-13 When stacked and nested together, the inner surface 168 of the recess 158 of the shipping tray 50 may abut with the outer surface 170 of the recess 158 of the foot 154 of another shipping tray 50.

The third front holder 106 may be rectangular, and may be larger and oriented differently than the first front holder 102 and the second front holder 104, as shown in FIG. 3. However, size, shape, and depth may vary depending on the bench 54 being accommodated. The third front holder 106 may be of any size, shape, and depth as deemed appropriate by one skilled in the art.

As shown in FIG. 1 the first rear holder 202, the second rear holder 204, and the third rear holder 206 may each be positioned along the rear support 200.

As shown in FIGS. 1, 3, and 4, the first rear holder 202 may include a foot 214 and a holder border 216. The foot 214 extends down from the underside 66 of the shipping tray 50. The foot 214 may further include recess 218 configured to receive one of a leg 56 of the plurality of legs 56 of the bench 54, the recess 218 receiving the leg 56 into it from a top 68 of the shipping tray 50. The holder border 216 may surround the recess 218, and may further include an angled side 220 connecting the holder border 216 to the rear support 200, and the first side support 300.

As shown in FIGS. 1 and 3, the recess 218 of the first rear holder 202 may have a base 222 with a drainage hole 224, and a plurality of walls 226. The plurality of walls 226 may angle inward relative to each other, and extend downward from the holder border 216 to the base 222. The plurality of walls 226 may have an inner surface 228, and an outer surface 230. In some embodiments, the recess 218 of the first font holder may be configured to receive the foot 214 of another shipping tray 50, as shown in FIGS. 12-13. When stacked and nested together, the inner surface 228 of the recess 218 of the shipping tray 50 may abut with the outer surface 230 of the recess 218 of the foot 214 of another shipping tray 50. The first rear holder 202, may be rectangular, as shown in FIG. 3. However, size, shape, and depth may vary depending on the bench 54 being accommodated. The first rear holder 202 may be of any size, shape, and depth as deemed appropriate by one skilled in the art.

As shown in FIGS. 1, 3, and 4, the second rear holder 204 may include a foot 234 and a holder border 236. The foot 234 extends down from the underside 66 of the shipping tray 50. The foot 234 may further include a recess 238 configured to receive one of a leg 56 of the plurality of legs 56 of the bench 54, the recess 238 receiving the leg 56 into it from the top 68 of the shipping tray 50. The holder border 236 may surround the recess 238, and may further include an angled side 240 connecting the holder border 236 to the rear support 200, and the second side support 400.

As shown in FIGS. 1 and 3, the recess 238 of the second rear holder 204 may have a base 242 with a drainage hole 244, and a plurality of walls 246. The plurality of walls 246 may angle inward relative to each other, and extend downward from the holder border 236 to the base 242. The plurality of walls 246 may have an inner surface 248, and an outer surface 250. In some embodiments, the recess 238 of the second rear holder 204 may be configured to receive the foot 234 of another shipping tray 50, as shown in FIGS. 12-13. When stacked and nested together, the inner surface 248 of the recess 118 of the shipping tray 50 may abut with the outer surface 250 of the recess 238 of the foot 234 of another shipping tray 50.

The second rear holder 204, may be rectangular, as shown in FIG. 3. However, size, shape, and depth may vary depending on the bench 54 being accommodated. The second rear holder 204 may be of any size, shape, and depth as deemed appropriate by one skilled in the art.

As shown in FIGS. 1, 3, and 4, the third rear holder 206 may be positioned between the first rear holder 202 and the second rear holder 204. The third rear holder 206 may include a foot 254 and a holder border 256. The foot 254 extends down from the underside 66 of the shipping tray 50. The foot 254 may further include a recess 258 configured to receive one of a leg 56 of the plurality of legs 56 of the bench 54, the recess 258 receiving the leg 56 into it from the top 68 of the shipping tray 50. The holder border 256 may surround the recess 258, and may further include an angled side 260 connecting the holder border 256 to the first arm 208 and the second arm 210 of the rear support 200.

As shown in FIGS. 1 and 3, the recess 258 of the third rear holder 206 may have a base 262 with a drainage hole 264, and a plurality of walls 266. The plurality of walls 266 may angle inward relative to each other, and extend downward from the holder border 256 to the base 262. The plurality of walls 226 may have an inner surface 268, and an outer surface 270. In some embodiments, the recess 258 of the third rear holder 206 may be configured to receive the foot 254 of another shipping tray 50, as shown in FIGS. 12-13. When stacked and nested together, the inner surface 268 of the recess 258 of the shipping tray 50 may abut with the outer surface 270 of the recess 258 of the foot of another shipping tray 50.

The third rear holder 206 may be rectangular, and may be larger and oriented differently than the first rear holder 202 and the second rear holder 204, as shown in FIG. 3. However, size, shape, and depth may vary depending on the bench 54 being accommodated. The third rear holder 206 may be of any size, shape, and depth as deemed appropriate by one skilled in the art.

As shown in FIGS. 1 and 3, the central support 58 may be disposed on the top 68 of the shipping tray 50, and may connect the third front holder 106 and the third rear holder 206.

As shown in FIGS. 1 and 3, the first X-support 500 may disposed on the top 68 of the shipping tray 50, and may include a center 510, a first arm 502, a second arm 504, a third arm 506, and a fourth arm 508. The first arm 502 may connect the first front holder 102 to the center 510. The second arm 504 may connect the third front holder 106 to the center 510, and the third arm 506 may connect the third rear holder 206 to the center 510. The fourth arm 508 may connect the first rear holder 202 to the center 510. Relative lengths and widths of the arms of the first X-support 500 may vary depending on the bench 54 being accommodated, considering the degree of support needed, and as determined by one skilled in the art.

As shown in FIGS. 1 and 3, the second X-support 600 may disposed on the top 68 of the shipping tray 50, and may include a center 610, a first arm 602, a second arm 604, a third arm 606, and a fourth arm 608. The first arm 602 may connect the second front holder 104 to the center 610. The second arm 604 may connect the third front holder 106 to the center 610, and the third arm 606 may connect the third rear holder 206 to the center 610. The fourth arm 608 may connect the second rear holder 204 to the center 610. Relative lengths and widths of the arms of the second X-support 600 may vary depending on the bench 54 being accommodated, considering the degree of support needed, and as determined by one skilled in the art.

As shown in FIGS. 2 and 4, the network of ribbing 64 may be disposed on the underside 66 of the shipping tray 50. The network of ribbing 64 may connect the front support 100, the rear support 200, the first side support 300, and the second side support 400. The network of ribbing 64 may also connect to and surround the foot 114 of the first front holder 102, the foot 134 of the second front holder 104, and the foot 154 of the third front holder 106. The network of ribbing 64 may also connect to and surround the foot 214 of the first rear holder 202, the foot 234 of the second rear holder 204, and the foot 254 of the third rear holder 206. The network of ribbing 64 may be grid-patterned, and oriented diagonally relative to the front support 100, the rear support 200, the first side support 300, and the second side support 400, as seen in FIGS. 2 and 4. However, the network of ribbing 64 may be in any orientation or arrangement as deemed appropriate by one skilled in the art, which may vary depending on the relative structural support required of the bench 54 being supported.

Figure 14:
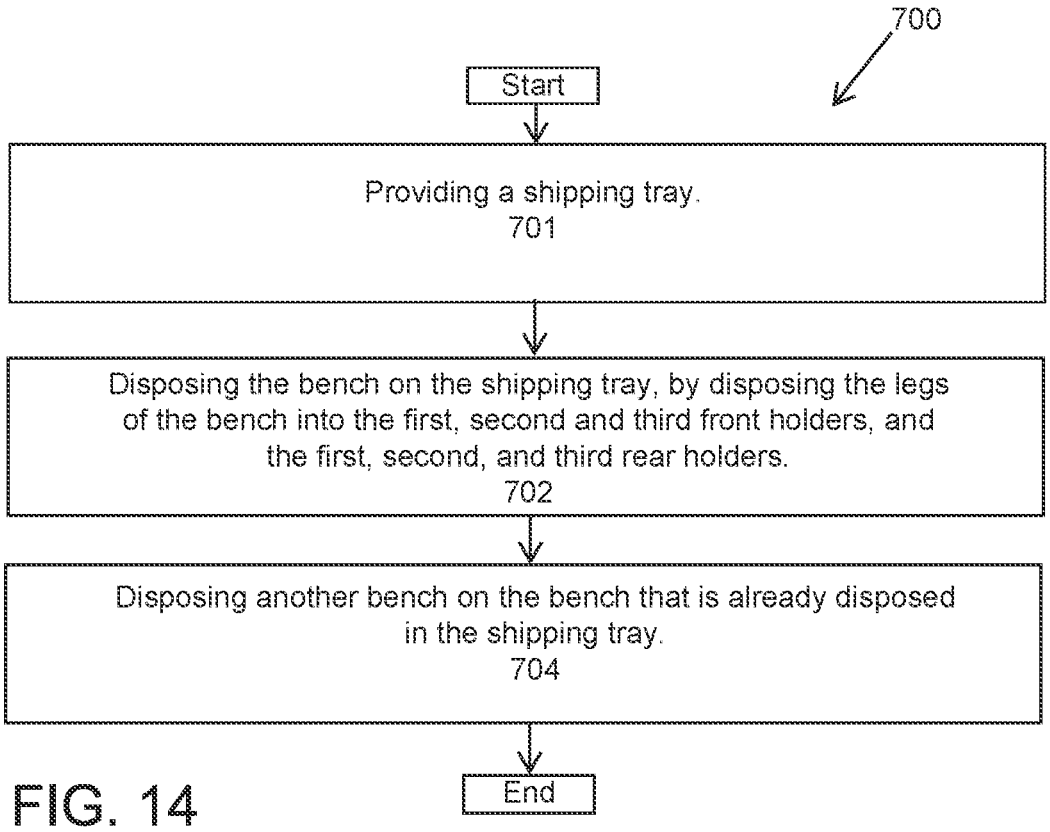
FIG. 14 is a flowchart of a method of stacking a bench on the shipping tray, and of stacking another of the bench on the bench that is already on the shipping tray.

FIGS. 9 and 10 illustrate how a bench 54 having a plurality of legs 56 can be stacked on the shipping tray 50. FIG. 14 shows a flowchart of a method 700 of stacking a bench 54 having a plurality of legs 56 on the shipping tray 50, the method 700 comprising a step 701 of providing a shipping tray 50. Next, the method 700 may include a step 702 of disposing the bench 54 on the shipping tray 50 by disposing a leg 56, of the plurality of legs 56 into each recess 118, 138, 158, 218, 238, 258, of the first front holder 102, the second front holder 104, the third front holder 106, the first rear holder 202, the second rear holder 204, and the third rear holder 206. Then, in some embodiments, as shown in FIG. 14, the method 700 may include a step 704 of stacking another bench 54 on top of the bench 54 disposed on the shipping tray 50. The bench 54 may nest and stack together with other benches on the shipping tray 50. In this way, the shipping tray 50 may prevent the weight of the nested stack of benches 54 from causing the plurality of legs 56 of the bottommost bench 54 from bending, warping, or splaying and thereby compromising or damaging one or more of the benches 54.

Figure 15:
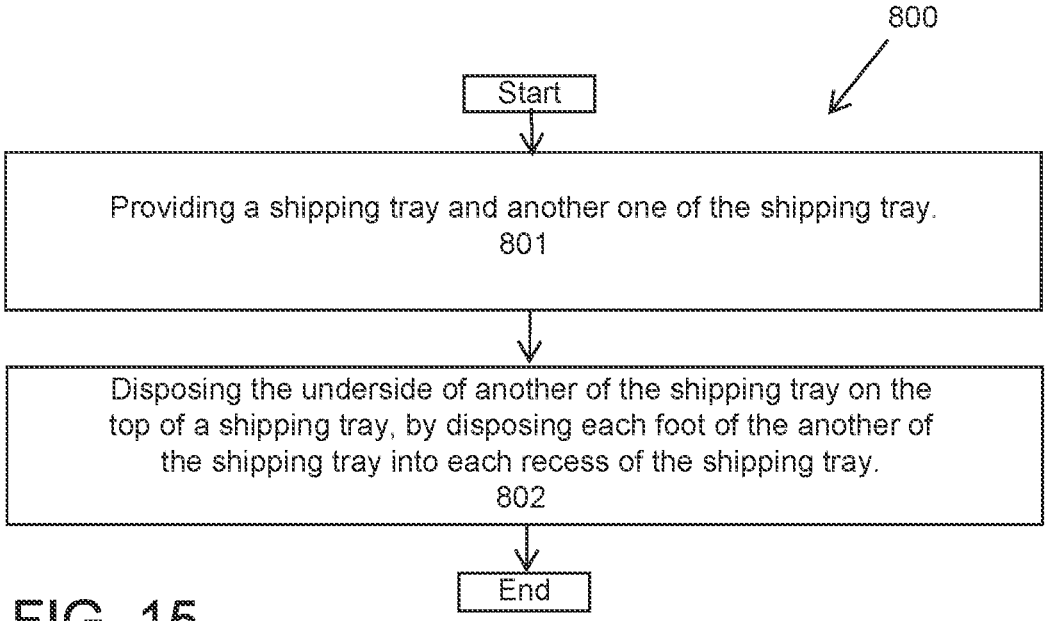
FIG. 15 is a flowchart of a method of stacking another shipping tray on a shipping tray.

FIGS. 12 and 13 illustrate how another shipping tray 50 can be stacked on the shipping tray 50. FIG. 15 shows a flowchart of a method 800 of stacking another shipping tray 50 on the shipping tray 50, comprising a step 801 of providing the shipping tray 50 and another shipping tray 50. The method 800 may include the step 802 of disposing the underside 66 of the another shipping tray 50 on the top 68 of the shipping tray 50. In some embodiments, this can be accomplished by disposing each foot 114, 134, 154, 214, 234, 254 of the another shipping tray 50 into each recess 118, 138, 158, 218, 238, 258 of the shipping tray 50. The outer surface 130, 150, 170, 230, 250, 270 of each recess 118, 138, 158, 218, 238, 258 of the another of the shipping tray 50 may abut the inner surface 128, 148, 168, 228, 248, 268 of each recess 118, 138, 158, 218, 238, 258 of the shipping tray 50. In this way, the shipping trays 50 can form a nested stack, where additional shipping trays 50 can be added. Nesting of the shipping trays 50 can optimize space and storage of shipping trays 50 prior to loading with benches 54 as well as after unloading benches 54 therefrom, where the shipping trays 50 can be returned for shipping more benches 54.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar results.

What is claimed is:

1. A shipping tray for a bench, the bench having a plurality of legs, the shipping tray comprising:

a front support, a rear support, a first side support, and a second side support forming a perimeter of the shipping tray;

a first front holder, a second front holder, and a third front holder, each positioned along the front support and each having a recess configured to receive a leg of the plurality of legs of the bench, the third front holder positioned between the first front holder and the second front holder;

a first rear holder, a second rear holder, and a third rear holder, each positioned along the rear support and each having a recess configured to receive a leg of the plurality of legs of the bench, the third rear holder positioned between the first rear holder and the second rear holder;

a central support connected to the third front holder and the third rear holder;

a first X-support connected to the first front holder, the first rear holder, the third front holder, and the third rear holder;

a second X-support connected to the second front holder, the second rear holder, the third front holder, and the third rear holder; and a network of ribbing disposed on an underside of the shipping tray, wherein:

the front support has a first length and the rear support has a second length, the first length being greater than the second length, the front support includes a first arm extending between the first front holder and the third front holder, and a second arm extending between the second front holder and the third front holder, the rear support includes a first arm extending between the first rear holder and the third rear holder, and a second arm extending between second rear holder and the third rear holder, and the first arm of the rear support angles inward toward the front support, from the first rear holder to the third rear holder, and the second arm of the rear support angles inward toward the front support, from the second rear holder to the third rear holder.

2. The shipping tray of claim 1, wherein the first side support extends between the first front holder and the first rear holder.

3. The shipping tray of claim 1, wherein the second side support extends between the second front holder and the second rear holder.

4. The shipping tray of claim 3, wherein the first side support has a plurality of openings formed within, and the second side support has a plurality of openings formed within.

5. The shipping tray of claim 1, wherein:

the network of ribbing connects the front support, the rear support, the first side support, and the second side support; and the network of ribbing connects to and surrounds a foot depending from the underside of the first front holder, the second front holder, the third front holder, the first rear holder, the second rear holder, and the third rear holder.

6. The shipping tray of claim 5, wherein the network of structural ribbing is grid-patterned, oriented diagonally relative to the front support, the rear support, the first side support, and the second side support.

7. A shipping tray for a bench, the bench having a plurality of legs, the shipping tray comprising:

a front support, a rear support, a first side support, and a second side support forming a perimeter of the shipping tray;

a first front holder, a second front holder, and a third front holder, each positioned along the front support and each having a recess configured to receive a leg of the plurality of legs of the bench, the third front holder positioned between the first front holder and the second front holder;

a first rear holder, a second rear holder, and a third rear holder, each positioned along the rear support and each having a recess configured to receive a leg of the plurality of legs of the bench, the third rear holder positioned between the first rear holder and the second rear holder;

a central support connected to the third front holder and the third rear holder;

a first X-support connected to the first front holder, the first rear holder, the third front holder, and the third rear holder;

a second X-support connected to the second front holder, the second rear holder, the third front holder, and the third rear holder; and a network of ribbing disposed on an underside of the shipping tray wherein:

each of the first front holder, the second front holder, and the third front holder include:

a foot extending down from the underside of the shipping tray, the foot including the recess, the recess configured to receive one leg of the plurality of legs of the bench from a top of the shipping tray; and a holder border surrounding the recess; and each recess includes:

a base having a drainage hole; and a plurality of side walls angled inward relative to each other and extending downward from the holder border to the base, the plurality of side walls having an inner surface and an outer surface.

8. The shipping tray of claim 7, wherein each recess is configured to receive a foot of another shipping tray, the inner surface of the recess of the shipping tray abutting the outer surface of the recess of the another shipping tray.

9. The shipping tray of claim 8, wherein each holder border includes an angled side connecting the holder border to one of the front support, the rear support, the first side support, and the second side support.

10. The shipping tray of claim 9, wherein the first X-support includes a center, a first arm, a second arm, a third arm and a fourth arm, the first arm connecting the first front holder to the center, the second arm connecting the third front holder to the center, the third arm connecting the first rear front holder to the center, and the fourth arm connecting the third rear holder to the center.

11. The shipping tray of claim 10, wherein the second X-support includes a center, a first arm, a second arm, a third arm, and a fourth arm, the first arm connecting the second front holder to the center, the second arm connecting the third front holder to the center, the third arm connecting the second rear holder to the center, the fourth arm connecting the third rear holder to the center.

12. A method of stacking a bench having a plurality of legs on a shipping tray, the method comprising:

providing a shipping tray including, a front support, a rear support, a first side support, and a second side support forming a perimeter of the shipping tray;

a first front holder, a second front holder, and a third front holder, each positioned along the front support and each having a recess configured to receive a leg of the plurality of legs of the bench, the third front holder positioned between the first front holder and the second front holder;

a first rear holder, a second rear holder, and a third rear holder, each positioned along the rear support and each having a recess configured to receive a leg of the plurality of legs of the bench, the third rear holder positioned between the first rear holder and the second rear holder;

a central support connected to the third front holder and the third rear holder;

a first X-support connected to the first front holder, the first rear holder, the third front holder, and the third rear holder;

a second X-support connected to the second front holder, the second rear holder, the third front holder, and the third rear holder; and a network of ribbing disposed on an underside of the shipping tray; and disposing the bench on the shipping tray by disposing a leg of the plurality of legs of the bench into each recess of the first front holder, the second front holder, the third front holder, the first rear holder, the second rear holder, and the third rear holder of the shipping tray.

13. The method of claim 12, further comprising stacking another bench on top of the bench disposed on the shipping tray.

14. A method of stacking a shipping tray on another shipping tray, the shipping tray configured for a bench having a plurality of legs, the method comprising:

providing a shipping tray and another shipping tray, each including:

a front support, a rear support, a first side support, and a second side support forming a perimeter of the shipping tray;

a first front holder, a second front holder, and a third front holder, each positioned along the front support and each having a recess configured to receive a leg of the plurality of legs of the bench, the third front holder positioned between the first front holder and the second front holder;

a first rear holder, a second rear holder, and a third rear holder, each positioned along the rear support and each having a recess configured to receive a leg of the plurality of legs of the bench, the third rear holder positioned between the first rear holder and the second rear holder;

a central support connected to the third front holder and the third rear holder;

a first X-support connected to the first front holder, the first rear holder, the third front holder, and the third rear holder;

a second X-support connected to the second front holder, the second rear holder, the third front holder, and the third rear holder; and a network of ribbing disposed on an underside of the shipping tray, wherein:

the front support has a first length and the rear support has a second length, the first length being greater than the second length, the front support includes a first arm extending between the first front holder and the third front holder, and a second arm extending between the second front holder and the third front holder, the rear support includes a first arm extending between the first rear holder and the third rear holder, and a second arm extending between second rear holder and the third rear holder, and the first arm of the rear support angles inward toward the front support, from the first rear holder to the third rear holder, and the second arm of the rear support angles inward toward the front support, from the second rear holder to the third rear holder; and disposing the shipping tray on the another shipping tray.

15. The method of claim 14, wherein, each of the first front holder, the second front holder, the third front holder, the first rear holder, the second rear holder, and the third rear holder of the first shipping tray and of the second shipping tray each include a foot extending down from the underside of the shipping tray, the foot including the recess, the recess configured to receive the foot of another shipping tray, wherein each recess includes a plurality of side walls having an inner face, and an outer face; and and the method further comprises disposing the shipping tray on the another shipping tray by disposing a respective foot of the shipping tray into a respective recess of the another shipping tray, where the outer wall of each recess of the shipping tray abuts the inner wall of the recess of the another shipping tray.

* * * * *